United States Patent [19]

Toyoshima et al.

[11] 3,979,648

[45] Sept. 7, 1976

[54] SYSTEM FOR OPERATING FIRE PREVENTION DEVICES

[75] Inventors: Shigeru Toyoshima, Nishinomiya; Mamoru Honda, Kashiwa; Katsuya Nakamura, Tokyo; Katsuhisa Seki, Ohmiya, all of Japan

[73] Assignee: Nohmi Bosai Kogyo Co., Ltd., Tokyo, Japan

[22] Filed: Mar. 10, 1975

[21] Appl. No.: 556,713

[52] U.S. Cl. ..... 317/139; 307/41; 340/223; 340/309.4; 317/137

[51] Int. Cl.[2] ..... H01H 47/14

[58] Field of Search ..... 317/40 R, 41, 25, 137, 317/139, 132, 133.5; 307/41, 115, 117, 132 T; 340/223, 228 R, 228.1, 228.2, 227 R, 309.4; 116/101

[56] References Cited

UNITED STATES PATENTS

| | | | |
|---|---|---|---|
| 2,538,789 | 1/1951 | Maynard | 317/139 |
| 2,667,630 | 1/1954 | Jorgensen | 340/228 R X |
| 2,709,250 | 5/1955 | Marmorstone | 317/137 X |
| 3,114,901 | 12/1963 | Capelle | 317/139 X |
| 3,423,637 | 1/1969 | Hillmann | 317/40 R X |
| 3,846,641 | 11/1974 | Eguchi | 317/139 X |

FOREIGN PATENTS OR APPLICATIONS

| | | | |
|---|---|---|---|
| 4,418,218 | 11/1966 | Japan | 340/227 R |

*Primary Examiner*—Harry Moose
*Assistant Examiner*—Patrick R. Salce
*Attorney, Agent, or Firm*—Amster & Rothstein

[57] ABSTRACT

The system for operating fire prevention devices comprises a plurality of fire prevention device operators successively operated directly or through another already operated operator in response to the operation of one of the fire detectors. Each of the operators includes switch means for switching the circuit from one operator to another when the fire prevention device associated therewith completes its operation. The switch means also function to switch the circuit upon the failure of the fire prevention device within a predetermined time.

2 Claims, 4 Drawing Figures

SYSTEM FOR OPERATING FIRE PREVENTION DEVICES

BACKGROUND OF THE INVENTION

This invention relates to systems for operating fire prevention devices, and more particularly to systems for operating a plurality of fire prevention devices such as fire shutters or smoke exhausting openings upon a fire breakout.

It is required to quickly and automatically operate fire shutters or smoke exhausting openings disposed in a building in response to the actuation of fire alarm equipment upon the fire breakout in order to prevent spreading of the fire site and to exhaust the smoke emitted from the fire. However, the conventional system with a plurality of fire prevention devices is arranged to simultaneously energize actuator coils which operate the fire prevention equipment. The actuator coils are connected in parallel through a make contact of a local relay which closes in response to the operation of one of the fire detectors disposed in an appropriate area of the building. Therefore, the system is required to have a large capacity electrical power source and the number and the size of the fire prevention devices, such as fire shutters and smoke exhausting openings, is limited.

Accordingly, the object of the present invention is to provide a system for operating fire prevention devices capable of operating a substantially unlimited number of fire prevention devices with a relatively small capacity electrical power source.

Another object of the invention is to provide a system for operating fire prevention devices operable in quick response to a fire breakout.

Still another object of the invention is to provide a system for operating fire prevention devices reliable in operation.

DESCRIPTION OF THE DRAWINGS

The invention will now be described in detail in conjunction with the preferred embodiments of the invention illustrated in the accompanying drawings in which.

DESCRIPTION OF THE PREFERRED EMBODIMENT

Figure 1:
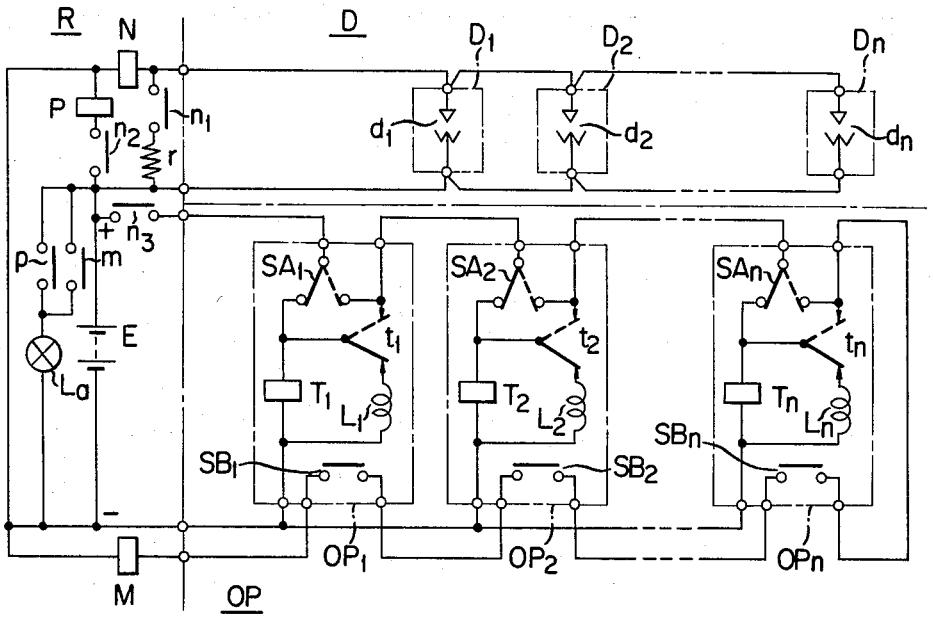
FIG. 1 is a schematic circuit diagram of the system for operating fire prevention devices constructed in accordance with the present invention.

Referring now to the drawing and in particular to FIG. 1, the system for operating fire prevention devices of the invention comprises a receiver unit R, a detector unit D and an operator unit OP.

The receiver unit R comprises a suitable d.c. electric source E, with which a local relay N is connected in series through its make contact $n_1$ and a resistor $r$. A flicker relay P is also connected in series with the electric source E through a series-connected make contact $n_2$ of the local relay N and in parallel with the series circuit composed of the local relay N, the make contact $n_1$ and the resistor $r$. An indication device, such as a lamp L$a$ in this embodiment, is connected in parallel with the electric source E through a pair of parallel-connected make contacts $p$ and $m$. The contact $p$ intermittently closes when the flicker relay P is energized, and the contact m follows the open-and-close operation of a relay M which is connected to the electric source E through a make contact $n_3$ of the local relay N and the operator unit OP composed of a plurality of operators $OP_1$, $OP_2$, . . . $OP_n$ which will be described in detail later for operating fire prevention devices (not illustrated). The indication lamp L$a$ may be replaced by any suitable indicator such as a buzzer, electric bell, etc.

The detector unit D comprises a plurality of fire detectors $D_1$, $D_2$ . . . $D_n$ each including a detector element $d_1$, $d_2$ . . . or $d_n$ and located at a suitable position in the area to be monitored such as the ceiling of the building. The detectors $D_1$, $D_2$ . . . $D_n$ are connected in parallel with one another across the make contact $n_1$ and the resistor $r$.

The operator unit OP comprises a plurality of parallel-connected fire prevention device operators $OP_1$, $OP_2$ . . . $OP_n$ connected across the electric source E through the make contact $n_3$ of the relay N. All the operators $OP_1$, $OP_2$ . . . $OP_n$ are identical in construction and, therefore, only first operator $OP_1$ will be described hereinbelow. The first fire prevention device operator $OP_1$ includes an actuator coil $L_1$ which, when energized, initiates the operation of the associated fire prevention device such as a shutter or a smoke exhaust opening. Connected in series with the actuator coil $L_1$ is a limit switch $SA_1$ which is switched from the first position (shown by a solid line) in which the actuator coil $L_1$ is energized through the first contact of the coil $L_1$ to the second position (shown by a broken line) in which the coil $L_1$ is deenergized and the coil $L_2$ in the next or second operator $OP_2$ is energized through the second contact of the coil $L_1$ when the operation of the fire prevention device is completed. Another switch or contact $t_1$ is connected in series with the actuator coil $L_1$, and the contact $t_1$ is adapted to switch, when a timer $T_1$ connected in parallel with the actuator coil $L_1$ is operated, from the first position (shown by a solid line) in which the coil $L_1$ can be energized through the first contact of the contact $t_1$ to the second position (shown by a broken line) in which the coil $L_1$ is deenergized and the actuator coil $L_2$ in the second operator $OP_2$ is energized through the second contact of the contact $t_1$. The operator $OP_1$ also comprises a limit switch $SB_1$ which is closed when the fire prevention device associated with the operator $OP_1$ is completely operated. The limit switches $SB_1$, $SB_2$ . . . $SB_n$ are series-connected to the electric source E through the relay M.

When one of the fire detectors $D_1 - D_n$ detects the fire and closes its contact, the local relay N is energized and closes its make contacts $n_1 - n_3$. Therefore, with the relay N being self-held through the contact $n_1$, the flicker relay P intermittently operates to repeat the energization and deenergization of the indication lamp L$a$ and the timer $T_1$ and the actuator coil $L_1$ of the first operator $OP_1$ are energized through the switches $SA_1$ and $t_1$. The actuator coil $L_1$ then initiates the operation of the fire prevention device by, for example, pulling out a pin which otherwise holds the fire shutter or the closure member of the fire prevention device in the inoperative state, thereby allowing the fire shutter to be closed by any suitable means such as a door closer or allowing the damper of the smoke exhausting port to open by its own weight.

When the fire prevention device associated with the operator $OP_1$ has completely closed, simultaneously with the closure of the switch $SB_1$, the limit switch $SA_1$ switches to the second position as shown by the broken line in FIG. 1. This deenergizes the timer $T_1$ and the coil $L_1$ and, at the same time, energizes the timer $T_2$ and the actuator coil $L_2$ of the second operator $OP_2$.

This mode of operation is then successively repeated for each of the second to the *n*th operators $OP_2$, $OP_3$, . . . $OP_n$ until all the operators are operated. After they are all operated, the limit switches $SA_1$, $SA_2$, . . . $SA_n$ are all switched to the second position and the limit switches $SB_1$, $SB_2$, . . . $SB_n$ are all closed. Then the relay M is operated to close its make contact *m* to cause the indication lamp L*a* which has been intermittently lit to be continuously energized, indicating that all the fire prevention device such as the shutters or the smoke exhausting ports are operated.

If one or other of the fire prevention devices, for example the device associated to the first operator $OP_1$, fails to operate for any reason, the limit switch $SA_1$ disposed in that first operator $OP_1$ does not switch to the second position. In that event, the timer $T_1$ actuates its switch contact *t* from the first position to the second position after the lapse of a predetermined time period. This deenergizes the coil $L_1$ in that failed operator $OP_1$ and energizes the timer $T_2$ and the actuator coil $L_2$ in the second operator $OP_2$.

Thus, according to the system for operating fire prevention devices of the present invention, each of the actuator coils $L_1$, $L_2$ . . . $L_n$ of the operators $OP_1$, $OP_2$ . . . $OP_n$, such as the fire shutters or the smoke exhausting openings, is operated successively one by one and not simultaneously. Therefore, the electric power source required for operating the fire prevention device can be of smaller capacity than that required for the conventional system, and even with such a smaller power source, the number and the size of the fire prevention devices is not limited. Further, with the system of the present invention, even if one or other of the fire prevention devices fails to operate for any reason, all of the remaining prevention devices in the system can be operated one by one, independently of the fire prevention device in trouble.

Figure 2:
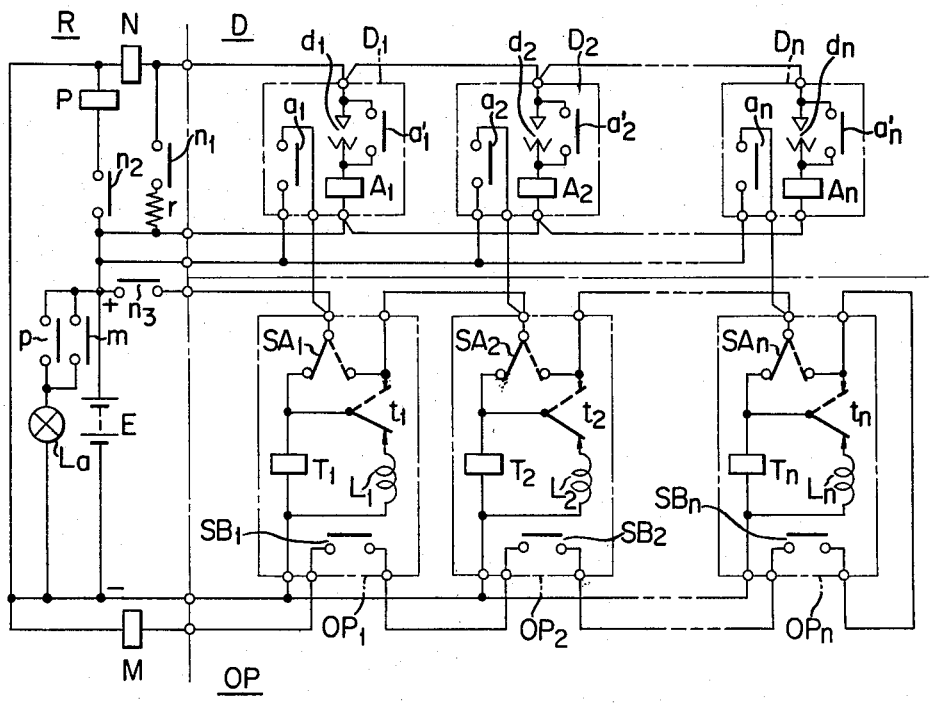
FIGS. 2 to 4 are schematic circuit diagrams of modified systems for operating fire prevention devices of the present invention.

Referring to FIG. 2, wherein another embodiment of the present invention is illustrated, the receiver unit R and the operator unit OP of this embodiment are the same as those illustrated in FIG. 1. All of the fire detectors $D_1$, $D_2$, . . . $D_n$ are identical in construction and therefore only the first detector $D_1$ will be described hereinbelow. The detector $D_1$ includes a detector element $d_1$ and a control relay $A_1$ connected in series with the detector element $d_1$ . A make contact $a'_1$ of the control relay $A_1$ is connected across the detector element $d_1$, while the other make contact $a_1$ of the control relay $A_1$ is connected between the electric source E and the limit switch $SA_1$ in parallel with the make contact $n_3$ of the local relay N. In other respects, the detectors are the same as those described in conjunction with FIG. 1.

With this circuit arrangement, when one of the fire detectors $D_n$ for instance detects the fire-breakout and closes its contact $d_1$, the local relay N operates to close the contacts $n_1 - n_3$. This causes the indication lamp La to begin flickering, the operators $OP_1 - OP_{n-1}$ to successively operate, and causes the control relay $A_n$ of the nth detector $D_n$ to close its contacts $a'_n$ and $a_n$, thereby self-holding the relay $A_n$. Then, the operator $OP_n$ of which limit switch $SA_n$ is connected to the contact $a_n$ of the detector $D_n$ operates to actuate the associated fire prevention device simultaneously with the operation of the first operator $OP_1$ which is carried out in the same way as in the system shown in FIG. 1. In other respects, the system operates similarly to that shown in FIG. 1.

With this circuit arrangement, the fire prevention device located closest to the fire site is first operated simultaneously with the first operator $OP_1$, providing quick and effective fire prevention.

Figure 3:
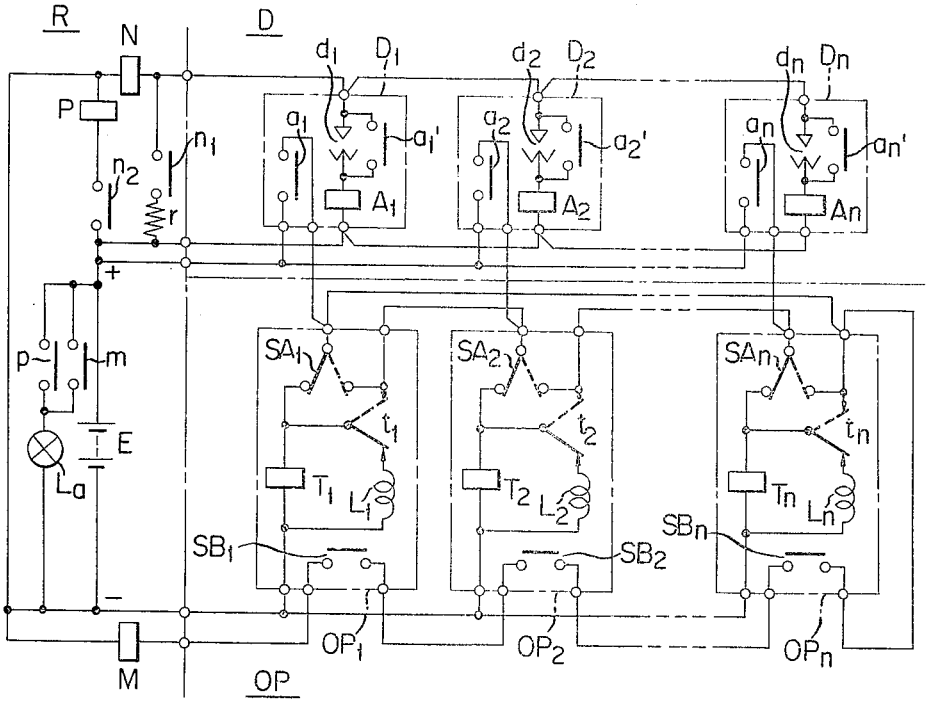

FIG. 3 illustrates still another embodiment of the present invention, in which the receiver unit R, the fire detector unit D and the operator unit OP themselves are identical to those shown in FIG. 2, only the connection between the respective units being different. That is, the electrical line and the make contact $n_3$ between the electric source E and the limit switch $SA_1$ of the first operator $OP_1$ are omitted from the system shown in FIG. 2, and the normally-open second contact of the limit switch $SA_n$ in the *n*th operator $OP_n$ is directly connected to the circuit point between the contact $a_1$ of the detector $D_1$ and the limit switch $SA_1$ of the first operator $OP_1$.

The circuit arrangement of this embodiment operates as follows: When one of the fire detectors, the *n*th detector $D_n$ for instance, detects the fire breakout and closes its contact $d_n$, the local relay N actuates to close its contacts $n_1$ and $n_2$, thereby causing the indication lamp L*a* to flicker similarly to the previous two embodiments. At the same time, the control relay $A_n$ is also actuated to close its contacts $a'_n$ and $a_n$, with the control relay $A_n$ being self-held, and the timer $T_n$ and the actuator coil $L_n$ of the operator $OP_n$ are energized to operate the fire prevention device, such as the fire shutter and the smoke exhausting opening, associated with that operator $OP_n$. After the fire prevention device operated by the operator $OP_n$ has completed its operation, the limit switch $SA_n$ switches from the first position to the second position to deenergize the timer $T_n$ and the actuator coil $L_n$ of the operator $OP_n$ and, at the same time, to energize the timer $T_1$ and the actuator coil $L_1$ of the first operator $OP_1$. This operation of the operator is successively repeated one by one until all of the operators $OP_1$, $OP_2$, . . . $OP_n$ complete their operations. After this, the system operates identically to those described in conjunction with FIGS. 1 and 2.

Figure 4:
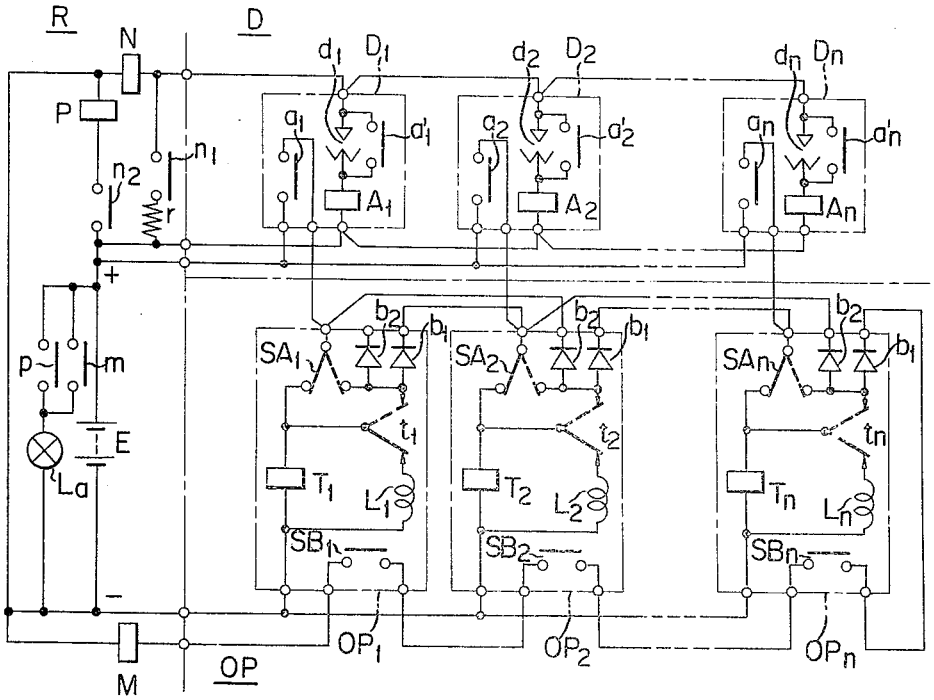

FIG. 4 shows a circuit arrangement of still another embodiment of the present invention, which only differs from the embodiment shown in FIG. 3 in that each of its operators $OP_1$, $OP_2$, . . . $OP_n$ includes two diodes $b_1$ and $b_2$. The diode $b_1$ of the second operator $OP_2$ is connected between the junction between the second contact of the limit switch $SA_2$ and the second contact of the contact $t_2$ and the limit switch of the subsequent or third operator. The diode $b_2$ of the second operator $OP_2$ is connected between the junction between the second contact of the limit switch $SA_2$ and the second contact of the contact $t_2$ and the limit switch of the preceding or first operator $OP_1$. In other words, the junction between the limit switch $SA_2$ and the contact $t_2$ is connected to the preceding and the subsequent operators through the separate diodes $b_1$ and $b_2$. Although the operators $OP_1$ and $OP_n$ also include the diodes $b_2$ and $b_1$, respectively, these diodes are not necessarily required for the proper operation of the system alone. These diodes may be left included for easy standardization of the operators, which allows the mass production of the operators as the identical interchangeable components.

With this circuit arrangement, when one of the fire detector $D_2$ for instance detects a fire breakout and closes its contact $d_2$, the local relay N is operated to start the flickering of the indication lamp L*a*. At the same time, the control relay $A_2$ also actuates its contacts $a'_2$ and $a_2$ to self-hold the control relay $A_2$ as well as to energize the timer $T_2$ and the actuator coil $L_2$ of the second operator $OP_2$, thereby actuating the fire prevention device, such as the fire shutter or the smoke exhausting opening, adapted to be operated by that operator $OP_2$. After this fire prevention device is completely operated, the limit switch $SA_2$ turns to the second position to deenergize the timer $T_2$ and the actuator coil $L_2$ and, simultaneously, energize the timer $T_1$ and the actuator coil $L_1$ of the preceeding or first operator $OP_1$ through the diode $b_2$ as well as the timer and the actuator coil of the subsequent or third operator through the diode $b_1$.

Thus, the operation of the fire prevention device starts from the operator associated with the fire detector that first detects the fire breakout and then shifts towards both ends of the system one by one on each side of the first operated operator until all the fire prevention devices involved in the system are completely operated. As in the previous embodiments, the indication lamp La is energized continuously after the operation of all the fire prevention devices, and if any of the fire prevention devices fail to operate completely, the remaining sound devices can successfully be operated due to the function of the timer T and its contact. This embodiment is preferable because it operates the fire prevention device that is the closest to the fire site and can operate the two neighbouring fire prevention devices on both sides of of the first-operated operator at the same time, enabling the system to more quickly and effectively prevent spreading of the fire site.

What is claimed is:

1. A system for operating fire prevention devices comprising a plurality of fire prevention device operators each comprising an actuator coil adapted to be energized in response to the operation of a fire detector directly or through another operator that has already been operated, means for deenergizing said energized actuator coil and energizing an actuator coil in another operator upon the completion of the operation of said fire prevention device associated with said energized actuator coil, means for deenergizing said energized actuator coil and energizing the actuator coil in said other operator when said fire prevention device associated with said energized actuator coil fails to complete its operation within a predetermined time, and an indication device which intermittently operates in response to the operation of said fire detectors and which continuously operates when all of said fire prevention devices complete their operations, said indication device operable by means disposed in the respective fire prevention devices.

2. A system for operating fire prevention devices comprising a plurality of fire prevention device operators each comprising an actuator coil adapted to be energized in response to the operation of a fire detector directly or through another operator that has already been operated, means for deenergizing said energized actuator coil and energizing an actuator coil in another operator upon the completion of the operation of said fire prevention device associated with said energized actuator coil, means for deenergizing said energized actuator coil and energizing the actuator coil in said other operator when said fire prevention device associated with said energized actuator coil fails to complete its operation within a predetermined time, an indication device which intermittently operates in response to the operation of said fire detectors and which continuously operates when all of said fire prevention devices complete their operations, said indication device being an indication lamp connected to an electric source through a contact of a flicker relay operable in response to the operation of the fire detectors through a local relay and through a contact of a relay connected in parallel to said contact of said flicker relay and operable by series-connected limit switches each disposed in the respective fire prevention devices, said limit switches each including a contact adapted to be closed when said first prevention device completes its operation.

* * * * *